US009242464B1

(12) United States Patent
Hayashi

(10) Patent No.: US 9,242,464 B1
(45) Date of Patent: Jan. 26, 2016

(54) LIQUID DROPLET DISCHARGE HEAD, IMAGE FORMING APPARATUS INCLUDING SAME, AND METHOD OF INSPECTING LIQUID DROPLET DISCHARGE HEAD

(71) Applicant: Keisuke Hayashi, Kanagawa (JP)

(72) Inventor: Keisuke Hayashi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/750,627

(22) Filed: Jun. 25, 2015

(30) Foreign Application Priority Data

Jul. 24, 2014 (JP) ..... 2014-150376

(51) Int. Cl.
*B41J 29/393* (2006.01)
*B41J 2/14* (2006.01)

(52) U.S. Cl.
CPC ..... *B41J 2/14233* (2013.01); *B41J 29/393* (2013.01)

(58) Field of Classification Search
CPC ..... B41J 2/16579; B41J 2/2142; B41J 2/125; B41J 2/04581; B41J 2/04541; B41J 2/0451
USPC ..... 347/9, 19, 44, 48, 68, 70–72
See application file for complete search history.

(56) References Cited

U.S. PATENT DOCUMENTS 7,475,960 B2 * 1/2009 Oku ..... B41J 2/0451 347/19
7,600,845 B2 * 10/2009 Ishizaki ..... B41J 2/0451 347/10
8,911,062 B2 * 12/2014 Kuwata ..... B41J 2/045 347/54

FOREIGN PATENT DOCUMENTS

| | | |
|---|---|---|
| JP | 10-100402 | 4/1998 |
| JP | 2002-331671 | 11/2002 |
| JP | 2003-170592 | 6/2003 |
| JP | 2006-281639 | 10/2006 |
| JP | 2013-240923 | 12/2013 |

* cited by examiner

*Primary Examiner* — An Do
(74) *Attorney, Agent, or Firm* — Cooper & Dunham LLP

(57) ABSTRACT

A liquid droplet discharge head includes a nozzle substrate; nozzles, disposed on the nozzle substrate, to discharge a liquid; a pressurized liquid chamber that communicates with the nozzles; a diaphragm forming one wall of the pressurized liquid chamber; an electromechanical transducer element for discharging, disposed on an element mount surface of the diaphragm opposite a side facing the pressurized liquid chamber; and a retainer substrate laminated to the element mount surface of the diaphragm with an adhesive. The subject head is configured to discharge a liquid inside the pressurized liquid chamber from the nozzles while the diaphragm is displaced by a drive voltage applied to the electromechanical transducer element for discharging, and the liquid droplet discharge head further comprising an electromechanical transducer element for inspection that does not perform discharging, disposed on the element mount surface of the diaphragm, to which a voltage is applied so that the diaphragm displaces.

6 Claims, 13 Drawing Sheets

LIQUID DROPLET DISCHARGE HEAD, IMAGE FORMING APPARATUS INCLUDING SAME, AND METHOD OF INSPECTING LIQUID DROPLET DISCHARGE HEAD

CROSS-REFERENCE TO RELATED APPLICATION

The present application claims priority pursuant to 35 U.S.C. §119(a) from Japanese patent application number 2014-150376, filed on Jul. 24, 2014, the entire disclosure of which is incorporated by reference herein.

BACKGROUND

1. Technical Field

The present invention relates to a liquid droplet discharge head, an image forming apparatus including the liquid droplet discharge head, and a method of inspecting the liquid droplet discharge head.

2. Background Art

This type of liquid discharge member includes the one used for inkjet recording apparatus that forms an image by causing a liquid inside a pressurized liquid chamber to be discharged from nozzles.

A conventional liquid jetting head or liquid discharging member includes a nozzle plate or substrate, a fluid channel forming substrate to form a pressure generating chamber or a pressurized liquid chamber that communicates to nozzles of the nozzle plate, all of which are laminated by an adhesive to form a liquid jetting head. The liquid jetting head includes a concave portion on a laminated surface between the nozzle plate and the fluid channel forming member to catch and therefore prevent excess adhesive from flowing into the pressure generating chamber.

SUMMARY

In one embodiment of the disclosure, there is provided a liquid droplet discharge head including a nozzle substrate; nozzles, disposed on the nozzle substrate, to discharge a liquid; a pressurized liquid chamber that communicates with the nozzles; a diaphragm forming one wall of the pressurized liquid chamber; an electromechanical transducer element for discharging, disposed on a surface of the diaphragm opposite a side facing the pressurized liquid chamber; and a retainer substrate laminated to the element mount surface of the diaphragm with an adhesive. The liquid droplet discharge head is configured to discharge a liquid inside the pressurized liquid chamber from the nozzles while the diaphragm is displaced by a drive voltage applied to the electromechanical transducer element for discharging, and the liquid droplet discharge head further includes an electromechanical transducer element for inspection that does not perform discharging, disposed on the element mount surface of the diaphragm, to which a voltage is applied so that the diaphragm displaces. A shortest distance of an adhesive leaking path from a laminated position of the adhesive to the diaphragm displacement area by the electromechanical transducer element for inspection is smaller than the shortest distance of the adhesive leaking path to the diaphragm displacement area by the electromechanical transducer element for discharging.

In another embodiment of the disclosure, there is provided an image forming apparatus to discharge a liquid from a liquid discharge head, thereby forming an image, including the liquid droplet discharge head as described above.

In another and further embodiment of the disclosure, there is provided an inspection method for a liquid droplet discharge head using an electromechanical transducer element for inspection, including detecting a displacement of a diaphragm displacement area by the electromechanical transducer element for inspection from a side of a pressurized liquid chamber; and inspecting a discharging operation of the liquid droplet discharge head based on a detection results obtained by the electromechanical transducer element for inspection.

These and other objects, features, and advantages of the present invention will become apparent upon consideration of the following description of the preferred embodiments of the present invention when taken in conjunction with the accompanying drawings.

DETAILED DESCRIPTION

Hereinafter, an embodiment in which a liquid droplet discharge head is applied to an inkjet recording apparatus as an image forming apparatus is described below.

Figure 1:
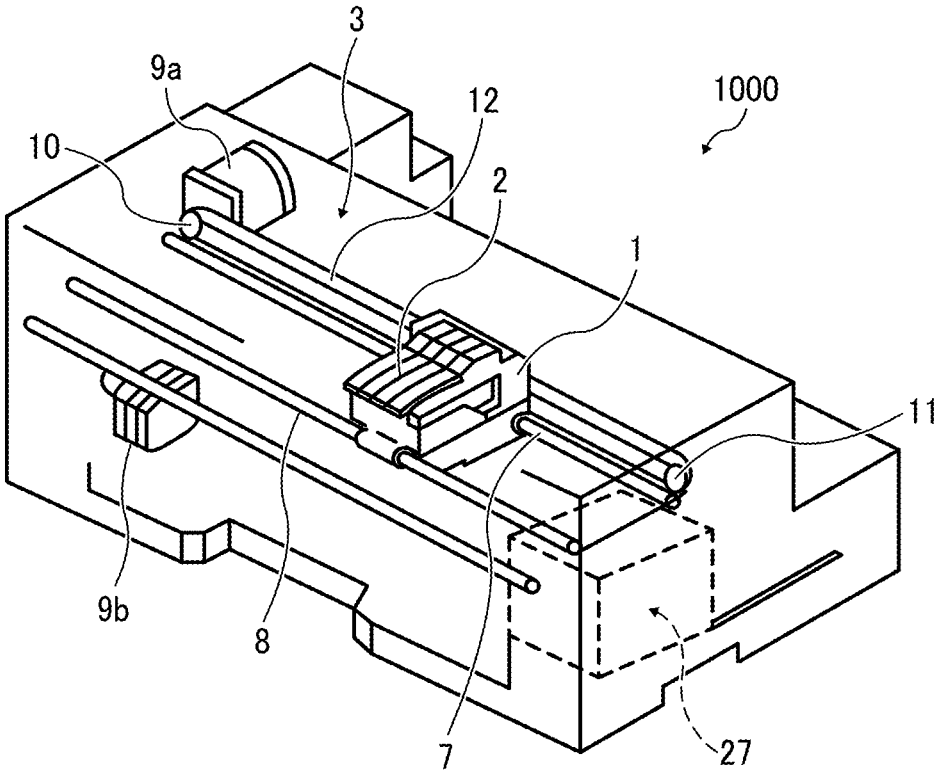
FIG. 1 is a perspective view of an inkjet recording apparatus according to an embodiment of the present invention.
Figure 2:
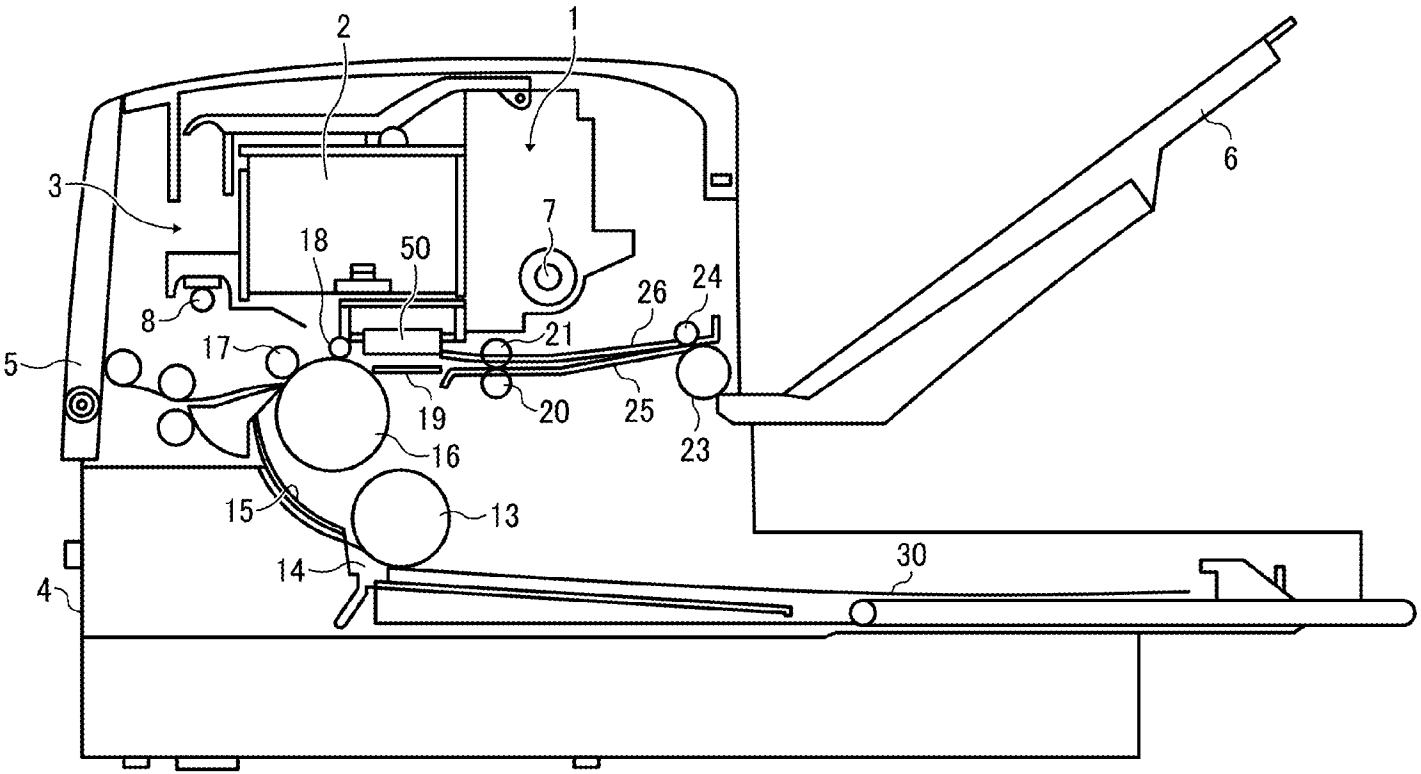
FIG. 2 is a side view of the inkjet recording apparatus of FIG. 1.

FIG. 1 illustrates a perspective view of an inkjet recording apparatus 1000 according to an embodiment of the present invention. FIG. 2 is a side view of the inkjet recording apparatus illustrating structural parts thereof.

The inkjet recording apparatus 1000 as illustrated in FIGS. 1 and 2 includes a carriage 1 movable in a main scanning direction. The inkjet recording apparatus 1000 further includes a liquid droplet discharge head 50 and an ink cartridge 2 to supply ink to the liquid droplet discharge head 50, both being mounted on the carriage 1.

A paper cassette or tray 4 disposed removably in the bottom of the apparatus body is capable of loading multiple recording media or sheets 30, and can be drawn from a front side of the apparatus body. In addition, a manual tray 5 that can be used to manually feed the sheet 30 is disposed. A printing unit 3 records a predetermined image on the sheet 30 fed out from the paper tray 4 or the manual tray 5, and the sheet 30 is discharged onto a sheet discharge tray 6 disposed at a rear side of the apparatus 1000. Herein, the recording media 30 includes various media such as paper, thread, fiber, fabric, leather, metals, plastics, glass, wood, ceramics, and the like.

The printing unit 3 includes a main guide rod 7 and an auxiliary guide rod 8, which are guide members disposed laterally between right and left side plates and hold the carriage 1 to be slidably movable in the main scanning direction. A liquid droplet discharge head 50 to discharge ink droplets of respective colors of yellow (Y), cyan (C), magenta (M), and black (Bk) is mounted on the carriage 1 with a plurality of ink discharge ports or nozzles arranged in a sub-scanning direction perpendicular to the main scanning direction, with the liquid droplet discharging direction oriented downward. Each of the ink cartridges 2 to supply ink of respective colors to the replaceable liquid droplet discharge head 50, which is mounted on the carriage 1.

The ink cartridge 2 includes an air hole disposed above, to communicate with the air, and a supply port disposed below, to supply the ink to the liquid droplet discharge head 50. There is an ink-filled porous body inside the ink cartridge 2, and the ink to be supplied to the liquid droplet discharge head 50 is kept at a slight negative pressure due to capillary force of the porous body. In addition, although liquid droplet discharge heads for respective colors are employed in the present embodiment, alternatively a single liquid droplet discharge head having nozzles to discharge ink droplets of different colors may be used.

The carriage 1 slidably engages the main guide rod 7 at a rear side of the apparatus (downstream in a sheet conveyance direction) and slidably engages the auxiliary guide rod 8 at a front side of the apparatus (upstream in the sheet conveyance direction). To move the carriage 1 in the main scanning direction, a timing belt 12 is held taut between a drive pulley 10 driven by a main scanning motor 9*a* and a driven pulley 11. The timing belt 12 is fixed to the carriage 1, so that the carriage 1 is driven to move reciprocally back and forth due to the back and forth rotation of the main scanning motor 9*a*.

On the other hand, a sheet feed roller 13 and a friction pad 14, both to separate and convey the sheets 30 one at a time from the paper tray 4, a guide member 15 to guide the sheet 30, and a conveyance roller 16 to reverse and convey the fed sheet 30 are disposed. Further, another conveyance roller 17 to be pressed against a peripheral surface of the conveyance roller 16, and a tip end roller 18 to define a conveyance angle of the sheet 30 from the conveyance roller 16 are disposed. The conveyance roller 16 is driven by a sub-scan motor 9*b* via a gear array.

A print receiver 19 serving as a sheet guide is disposed. The print receiver 19 guides the sheet 30 sent from the conveyance roller 16, below the liquid droplet discharge head 50 corresponding to a moving range of the carriage 1 in the main scanning direction. A conveyance roller 20 and a spur 21 are disposed downstream of the print receiver 19 in the sheet conveyance direction and rotate to convey the sheet 30 to a sheet ejection direction. The sheet discharge roller 23 and a spur 24 to send the sheet 30 to the sheet discharge tray 6, and guide members 25, 26 to form a sheet discharge path are disposed.

In recording an image, the liquid droplet discharge head 50 is driven in response to image signals, while moving the carriage 1, to allow the head 50 to discharge ink onto the stopped sheet 30 to record a single line. After the sheet 30 is conveyed by a predetermined amount, a next line is recorded. Upon receiving a recording end signal or a signal indicating that a trailing edge of the sheet 30 has reached the recording area, the recording operation is terminated and the sheet 30 is ejected.

A recovery unit 27 to recover discharge failure of the liquid droplet discharge head 50 is disposed at one end in the moving direction of the carriage 1 and outside the recording area. The recovery unit 27 includes a cap, a suction means, and a cleaner. In the standby time, the carriage 1 moves toward the recovery unit 27, where the liquid droplet discharge head 50 is capped by the cap, so that the nozzles of the liquid droplet discharge head 50 are kept damped and discharge failure due to ink drying can be prevented. In addition, by discharging unnecessary ink for recording during operation, ink viscosity of all nozzles is kept constant, thereby maintaining stable discharging performance.

When a discharge failure occurs, the nozzles of the liquid droplet discharge head 50 are sealed by the cap, and the suction means sucks out the ink and bubbles via the tube from the nozzles. With this operation, the ink and dust adhered around the nozzle surface are removed by the cleaner and the discharge failure is recovered. The sucked ink is discharged into a waste ink reservoir disposed in the bottom of the apparatus, and is absorbed by an ink absorber disposed inside the waste ink reservoir.

Next, the structure of the liquid droplet discharge head 50 is described.

Figure 3:
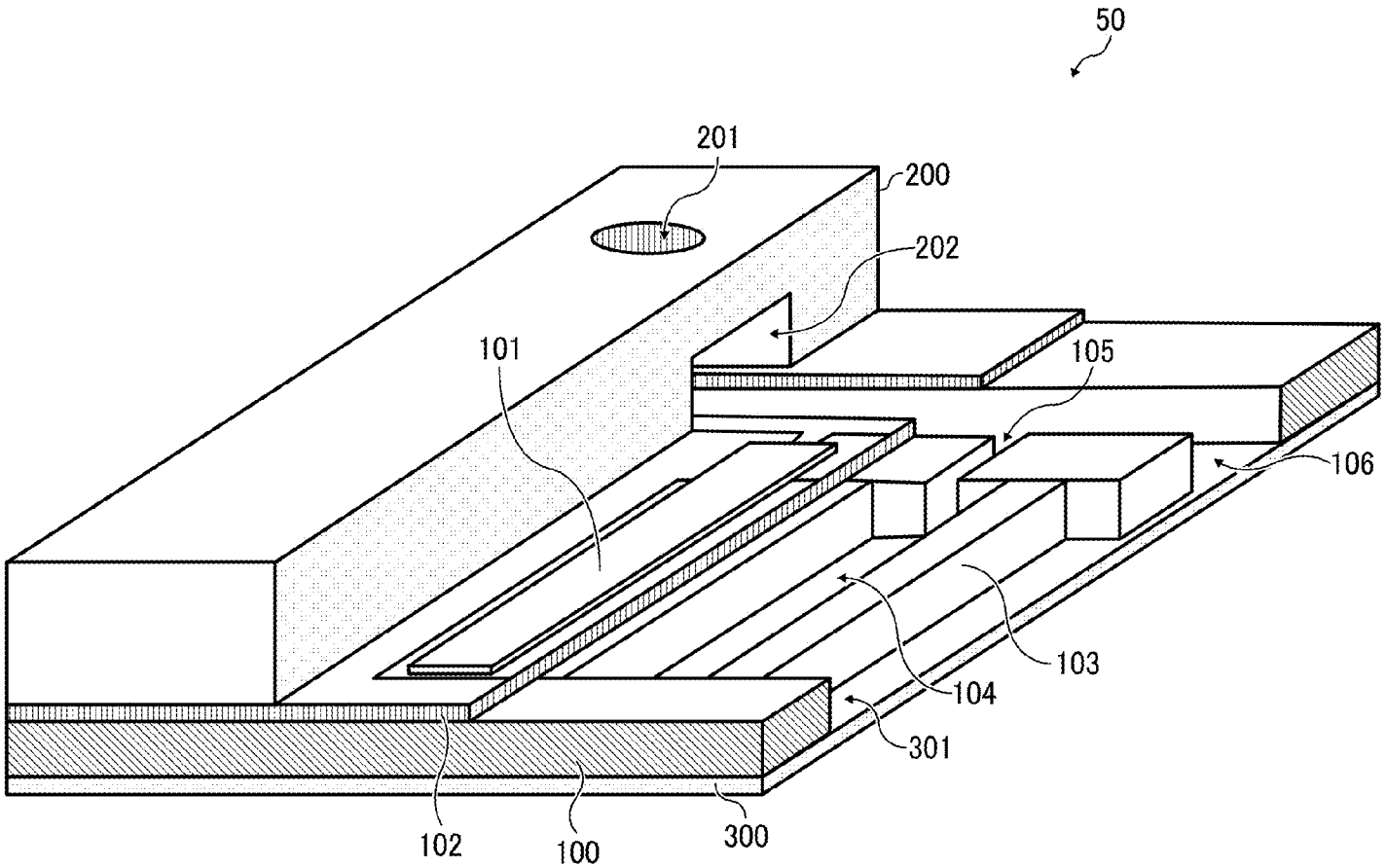
FIG. 3 is a partial perspective view illustrating an inner structure of a liquid droplet discharge head disposed in the inkjet recording apparatus of FIG. 1.
Figure 4:
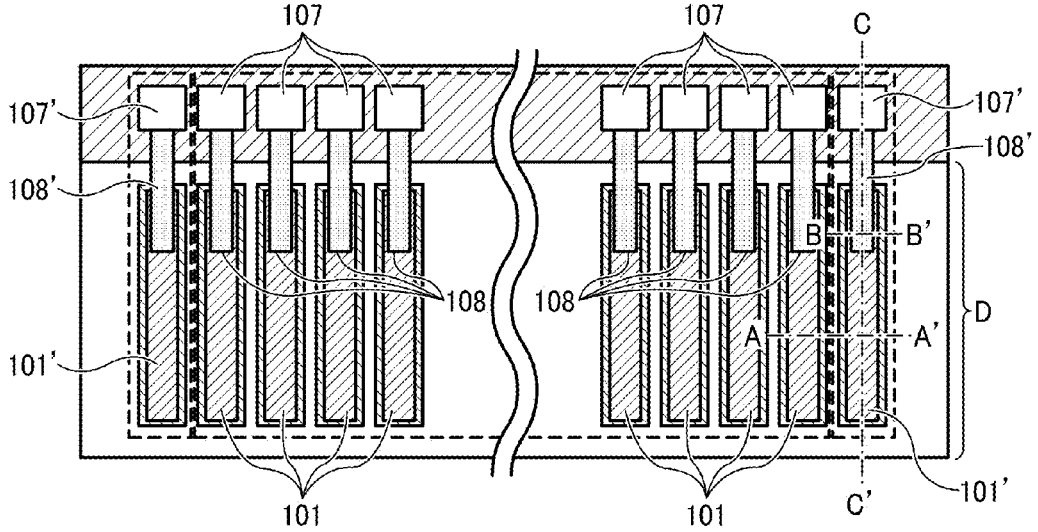
FIG. 4 illustrates an upper surface of an actuator substrate that constructs the liquid droplet discharge head.
Figure 5:
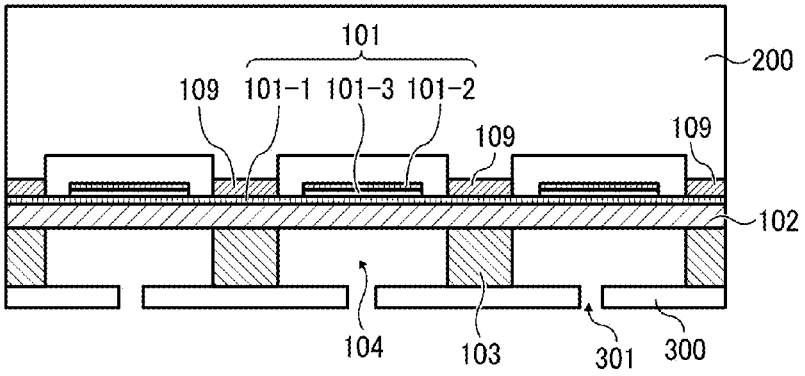
FIG. 5 is a cross-sectional view of the liquid droplet discharge head along line A-A' in FIG. 4.
Figure 6:
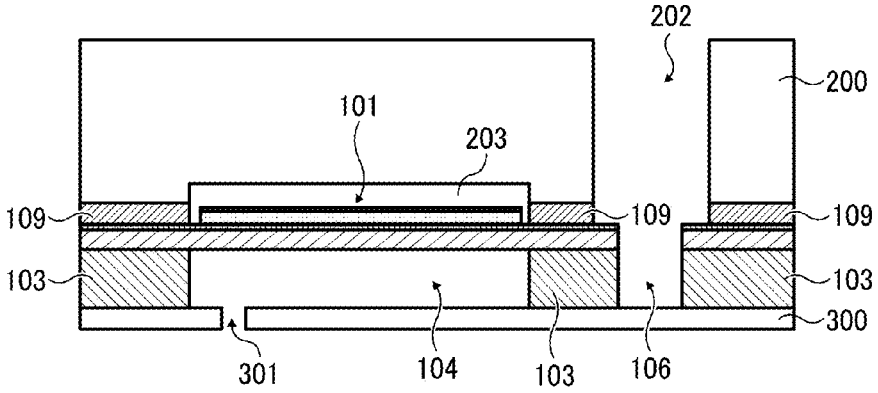
FIG. 6 is a cross-sectional view of the liquid droplet discharge head along line C'-C in FIG. 4.

FIG. 3 is a partially exploded perspective view illustrating an interior of the liquid droplet discharge head 50 according to an embodiment of the present invention. FIG. 4 illustrates an upper surface of an actuator substrate that constructs the liquid droplet discharge head 50. FIG. 5 is a cross-sectional view of the liquid droplet discharge head 50 along line A-A' in FIG. 4. FIG. 6 is a cross-sectional view of the liquid droplet discharge head along line C'-C in FIG. 4.

The liquid droplet discharge head 50 according to the present embodiment mainly includes an actuator substrate 100, a retainer substrate 200, and a nozzle substrate 300. The actuator substrate 100 includes a diaphragm 102 serving as a displacement plate and a piezoelectric element 101 as an electromechanical transducer element to generate energy to discharge a liquid. The piezoelectric element 101 is disposed on an upper surface of the diaphragm 102. The piezoelectric element 101 according to the present embodiment includes, as illustrated in FIG. 5, a common electrode layer 101-1 as a lower electrode, an individual electrode layer 101-2 as an upper electrode, and a piezoelectric layer 101-3 disposed between the common electrode layer 101-1 and the individual electrode layer 101-2. In addition, the actuator substrate 100 includes a partition wall 103 disposed on a side opposite the surface of the diaphragm 102 on which to mount the element (that is, below the diaphragm 102 in the figure). A space surrounded by the diaphragm 102, the partition wall 103, and the nozzle substrate 300 forms a pressurized liquid chamber 104. Further, a fluid resistor 105 and a common liquid chamber 106 are formed by the actuator substrate 100.

The retainer substrate 200 includes an ink supply port 201 to supply ink from the ink cartridge 2, and when the actuator substrate 100 is connected to the ink supply port 201, a space 203 is formed. The space 203 is a space in which a common ink channel 202 and the diaphragm 102 of the actuator substrate 100 bends and displaces. The retainer substrate 200 is formed from silicon that is subjected to etching, or from plastic mold.

The nozzle substrate 300 includes nozzles 301 formed at positions corresponding to respective pressurized liquid chambers 104. The nozzle substrate 300 may be formed of sheet metal such as stainless steel (SUS) which is subjected to punching, etching, silicon etching, nickel electroforming, resin laser processing, and the like.

The liquid droplet discharge head 50 according to the present embodiment applies drive voltage to the individual electrode layer 101-2 with each pressurized liquid chamber 104 filled with ink under the control of a controller. Pulse voltage of 20 volts generated by an oscillation circuit can be used as drive voltage. By applying such pulse voltage, the piezoelectric layer 101-3 itself contracts in a direction parallel to the diaphragm 102 due to piezoelectric effects. As a result, the diaphragm 102 contracts to be a convex shape toward the pressurized liquid chamber 104, so that the pressure inside the pressurized liquid chamber 104 drastically increases and ink is discharged from the nozzle 301 communicating to the pressurized liquid chamber 104.

Upon application of the pulse voltage, the contracted piezoelectric layer 101-3 recovers to an initial state, and the diaphragm 102 that has bent correspondingly returns to an original place. Accordingly, the pressure inside the pressurized liquid chambers 104 becomes negative compared to an interior of the common liquid chamber 106, and the ink supplied from the ink cartridge 2 via the ink supply port 201 is supplied to the pressurized liquid chambers 104 from the common ink channel 202 and the common liquid chamber 106 via the fluid resistor 105. By performing the above operation repeatedly, the ink droplets can be discharged continuously, and an image is formed to the rerecording medium disposed opposite the liquid droplet discharge head 50.

Next, a method for producing the liquid droplet discharge head 50 according to the present embodiment is described below.

FIGS. 7A to 9C are cross-sectional views illustrating steps of producing the liquid droplet discharge head 50 along a direction perpendicular to a direction in which nozzles are arranged.

Figure 7A:
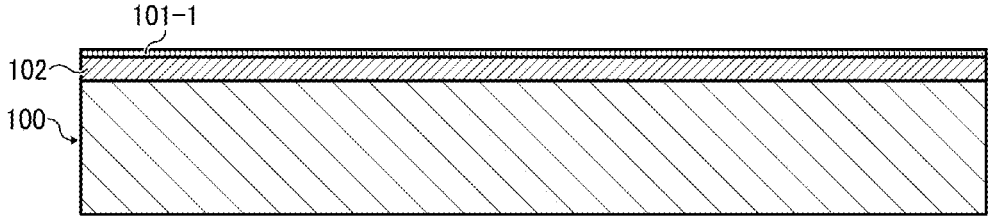
FIGS. 7A to 7D are cross-sectional views illustrating pretreatment steps for producing the liquid droplet discharge head along a direction perpendicular to a direction in which nozzles are arranged.

First, as illustrated in FIG. 7A, a film which will be the diaphragm 102 is formed on a single-crystal silicon substrate of a plane direction (110) having a depth of 400 μm, as the actuator substrate 100. The diaphragm 102 may be a single layer film or alternatively a laminated film as long as a function as a diaphragm and consistency to later processes can be secured. Preferred materials for the diaphragm 102 include silicon oxide film, polysilicon film, amorphous silicon film, silicon nitride film, or the like, that is laminated in layers via low pressure chemical vapor deposition (LP-CVD) method so as to have a desired rigidity as the diaphragm. Considering the process consistency, rigidity of the diaphragm, and reactive force of the diaphragm as a whole, the number of laminated layers is preferably from three to seven. However, to secure adherence between the diaphragm 102 and the common electrode layer 101-1 formed on the diaphragm 102, a topmost layer of the diaphragm 102 is preferably a silicon oxide film formed via LP-CVD method. Then, as the common electrode layer 101-1 formed on the diaphragm 102, $TiO_2$ and Pt that are subjected to sputtering to form respective films of 50-nm-thick and 100-nm-thick may be employed.

Figure 7B:
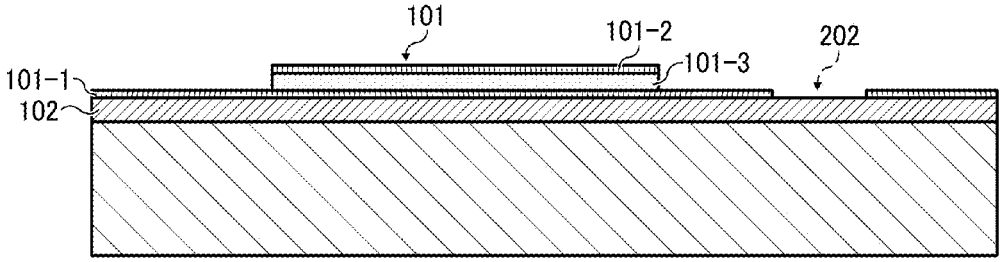

Next, as illustrated in FIG. 7B, a piezoelectric layer 101-3 is formed on the common electrode layer 101-1. Exemplary piezoelectric layer 101-3 is formed such that PZT is film-formed by spin coating in several times and a final film of 2-μm-thick is obtained. After the piezoelectric layer 101-3 is film-formed, Pt is subjected to sputtering to form a film having a thickness of 100 nm to obtain the individual electrode layer 101-2. Herein, film formation of the piezoelectric layer 101-3 is not limited to the spin coating method, but may employ sputtering method, ion plating method, air-sol method, sol-gel method, and inkjet method. After the piezoelectric layer 101-3 is film-formed, the individual electrode layer 101-2 and the piezoelectric layer 101-3 are subjected to lithographic etching method and patterned, and the piezoelectric element 101 is formed at a position corresponding to the pressurized liquid chamber 104, which will be later formed. In this case, part of the common electrode layer 101-1 which will be a common ink channel 202 later is patterned and removed.

Figure 7C:
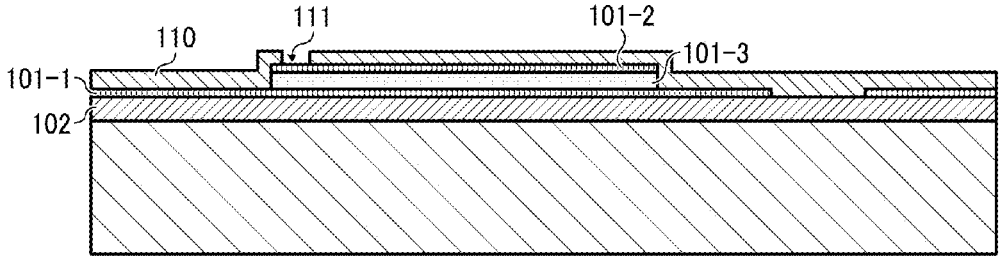

Next, as illustrated in FIG. 7C, an interlayer insulation film 110 is formed to insulate a portion between the common electrode layer 101-1 and the piezoelectric element 101, and the lead-out wire 108 which will later be formed. The interlayer insulation film 110 can be film-formed from $SiO_2$ by plasma-enhanced chemical vapor deposition (plasma CVD) method. The interlayer insulation film 110 may employ any insulation film other than the $SiO_2$ film formed by plasma CVD method as long as the film does not adversely affect the piezoelectric element 101 or materials for electrodes and can exert insulation properties. After the interlayer insulation film 110 is formed, a connection hole 111 to connect the individual electrode layer 101-2 to the lead-out wire 108 is formed by lithographic etching method. Although not illustrated, when the common electrode layer 101-1 is connected to another lead-out wire, another connection hole is to be formed in the interlayer insulation film 110, similarly.

Figure 7D:
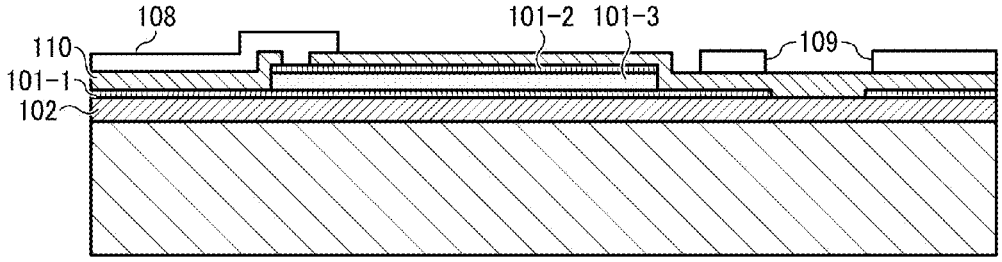

Next, as illustrated in FIG. 7D, the lead-out wire 108 is film-formed from, for example, TiN and Al having a respective thickness of 30 nm and 1 μm, by sputtering method. Al as a material for the lead-out wire 108 directly contacts the individual electrode layer 101-2 on the bottom of the connection hole 111, and forms an alloy due to heat in the later process, and its volume changes. A TiN film serves as a barrier layer that prevents the film from peeling due to the stress of change in volume. In addition, when the lead-out wire 108 is film-formed, an attached member 109, to which the retainer substrate 200 is later attached, are also film-formed.

Figure 8A:
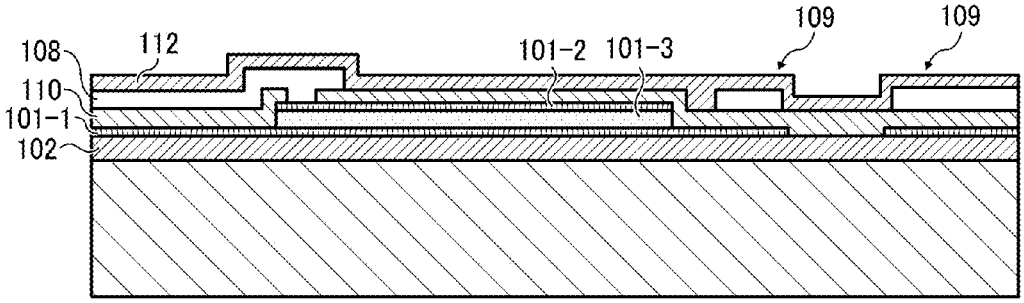
FIGS. 8A to 8C are cross-sectional views illustrating intermediate steps for producing the liquid droplet discharge head along the direction perpendicular to the direction in which nozzles are arranged.
Figure 8B:
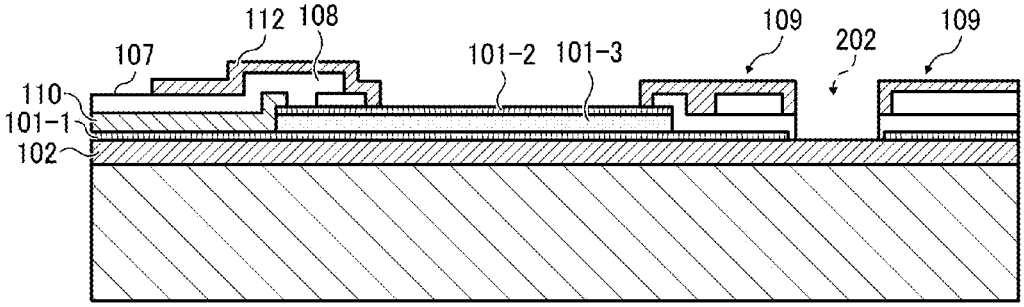
Figure 8C:
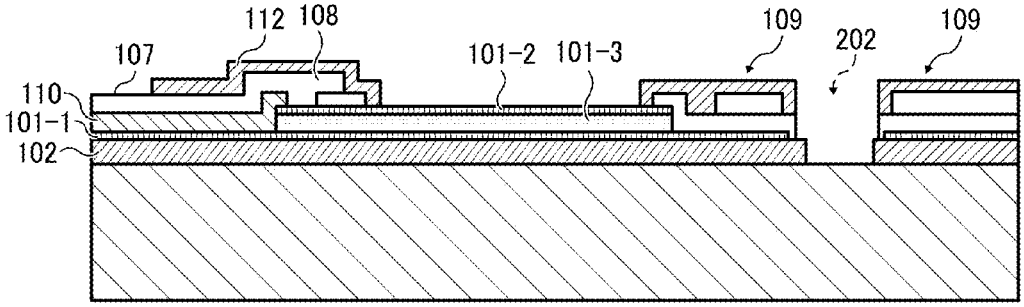

FIG. 8A illustrates a silicon oxide film formed by plasma CVD method as a passivation film 112 having a thickness of 1000 nm. Thereafter, as illustrated in FIG. 8B, via the lithographic etching method, an end of the lead-out wire 108 being an individual electrode pad 107, part of an upper surface of the piezoelectric element 101, and the passivation film 112 and the interlayer insulation film 110 at the common ink channel 202 are removed. FIG. 8C illustrates that the diaphragm 102 at a portion where the common ink channel 202 and the common liquid chamber 106 communicate is removed.

Figure 9A:
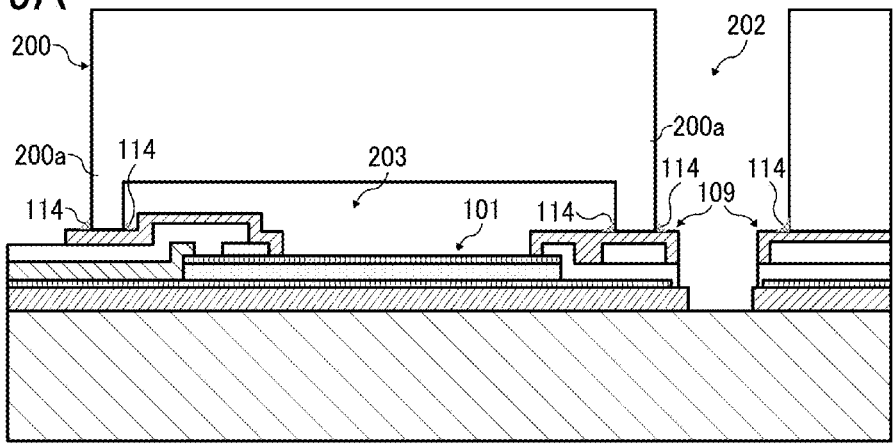
FIGS. 9A to 9C are cross-sectional views illustrating post-treatment steps for producing the liquid droplet discharge head along the direction perpendicular to the direction in which nozzles are arranged.

Next, as illustrated in FIG. 9A, the retainer substrate 200 including foot portions 200*a* forms the space 203 at a position corresponding to a diaphragm displacement area 113, that will be described later. The foot portions 200*a* and the attached member 109 formed on the diaphragm 102 of the actuator substrate 100 are laminated by an adhesive 114. In this case, the adhesive 114 may employ a general thin film transfer device so as to be laminated by a thickness of from 1 to 4 μm on the attached member 109 of the diaphragm 102. Bottom surfaces of the foot portions 200*a* are then pressed on the attached member 109 to complete lamination.

Figure 9B:
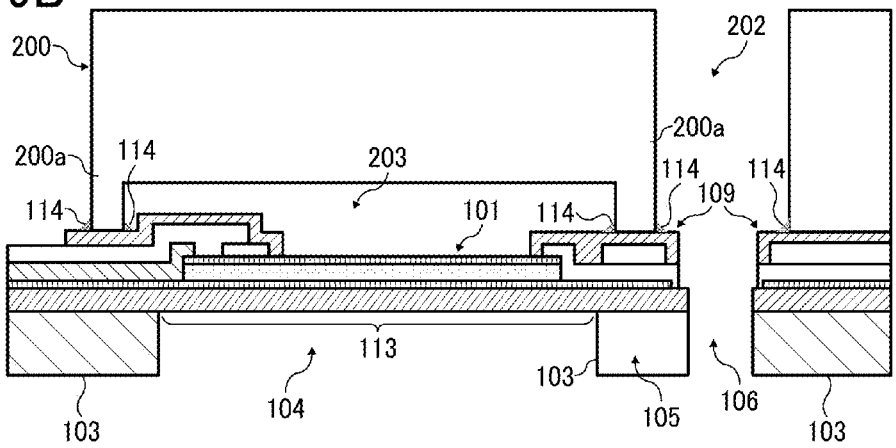
Figure 9C:
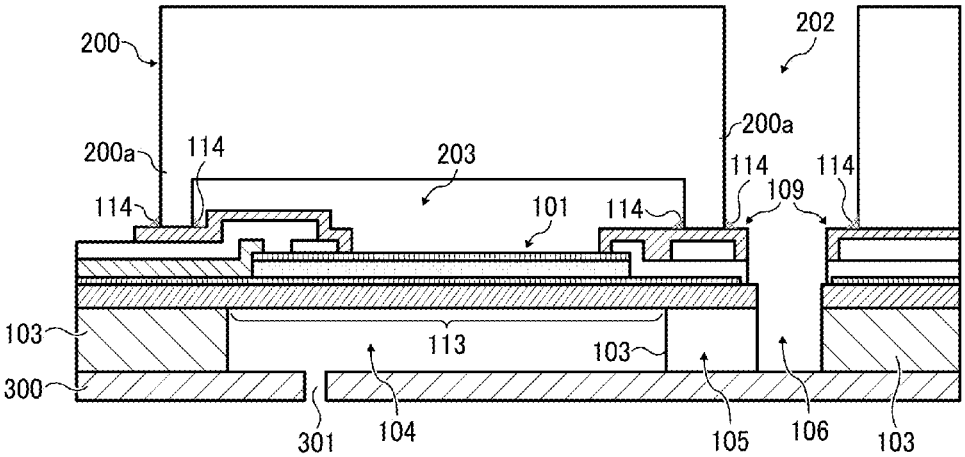

As illustrated in FIG. 9B, the partition wall 103 of the pressurized liquid chamber 104 and the common liquid chamber 106 other than the fluid resistor 105 are film-formed by the resist and are subjected to anisotropic wet-etching via the alkali solution (that is, potassium hydroxide (KOH) solution or tetramethylammonium hydroxide (TMHA) solution), and the pressurized liquid chamber 104, the common liquid chamber 106, and the fluid resistor 105 are formed. Other than the anisotropic etching via the alkali solution, the pressurized liquid chamber 104, the common liquid chamber 106, and the fluid resistor 105 can be formed by dry etching using ICP etcher. Then, as illustrated in FIG. 9C, the nozzle substrate 300 with nozzles 301 is laminated so that the open nozzles 301 correspond to the respective pressurized liquid chambers 104.

The description above concerning the method for producing the liquid droplet discharge head 50 is an example, and is not limited thereto. For example, at least one protective layer to cover the piezoelectric element 101 can be formed.

Next, a description will be given of a piezoelectric element 101' for inspection according to the present embodiment.

The actuator substrate 100 according to the present embodiment includes the piezoelectric element 101 as the electromechanical transducer element for discharging that allows the nozzles to discharge ink from the nozzles 301, that is, the piezoelectric element 101 for discharging, and the piezoelectric element 101' for inspection that serves as the electromechanical transducer element for inspection. In the present embodiment, a single piezoelectric element 101' for inspection is disposed at both lateral ends of the piezoelectric elements 101 for discharging disposed along the alignment direction of the nozzles.

The common electrode layer 101-1 is an electrode layer that is common to all the piezoelectric element 101 for discharging and the piezoelectric element 101' for inspection, and is electrically grounded. As illustrated in FIG. 4, the individual electrode layer 101-2 is disposed on each of the piezoelectric element 101 and 101' and is connected to the individual electrode pad 107 and 107' for external connection via the lead-out wire 108 and 108'. A driver IC to drive the piezoelectric element to apply the drive voltage formed of pulse voltage with a predetermined amplitude and frequency is connected to the individual electrode pad 107 and 107'. An area D on the actuator substrate 100 in FIG. 4 is an area covered by the retainer substrate 200.

In the present embodiment, the adhesive 114 is at least used for laminating the actuator substrate 100 with the retainer substrate 200. In the lamination, when the attached members 109 of the retainer substrate 200 and the foot portions 200*a* of the retainer substrate 200 are laminated, an excessive adhesive 114 leaks from the laminated surfaces to reach the diaphragm displacement area 113. The diaphragm displacement area 113 corresponds to an area where the diaphragm 102 bends or displaces due to deformation of the piezoelectric elements 101, 101', and corresponds to a portion of the diaphragm 102 that constructs a wall of the pressurized liquid chamber 104 as illustrated in FIG. 9B or 9C. When the adhesive 114 reaches the diaphragm displacement area 113, the rigidity of the diaphragm displacement area 113 changes and the bending/displacement amount of the diaphragm 102 changes due to the deformation of the piezoelectric elements 101, 101'. As a result, the diaphragm 102 cannot be bent or displaced as desired and a discharge failure may occur.

It is therefore important to inspect for a faulty liquid droplet discharge head 50. However, in detecting and inspecting the displacement of each of the diaphragm displacement area 113 due to the piezoelectric element 101 for discharging corresponding to each nozzle 301, because there are multiple nozzles 301 existing in the inkjet recording apparatus according to the piezoelectric element, inspection processes are complicated.

Then, in the present embodiment, other than the piezoelectric element 101 to discharge droplets, the piezoelectric element 101' for inspection that does not discharge droplets is disposed on the diaphragm 102. With this configuration, a structure specialized for inspection is adapted to the piezoelectric element 101' for inspection, without any discharging operation. In the present embodiment, a shortest distance of the adhesive leaking path from the laminated position of the adhesive 114 to the diaphragm displacement area 113 by the piezoelectric element 101' for inspection is smaller than the shortest distance of the adhesive leaking path to the diaphragm displacement area 113 by the piezoelectric element 101 for discharging droplets.

Figure 10A:
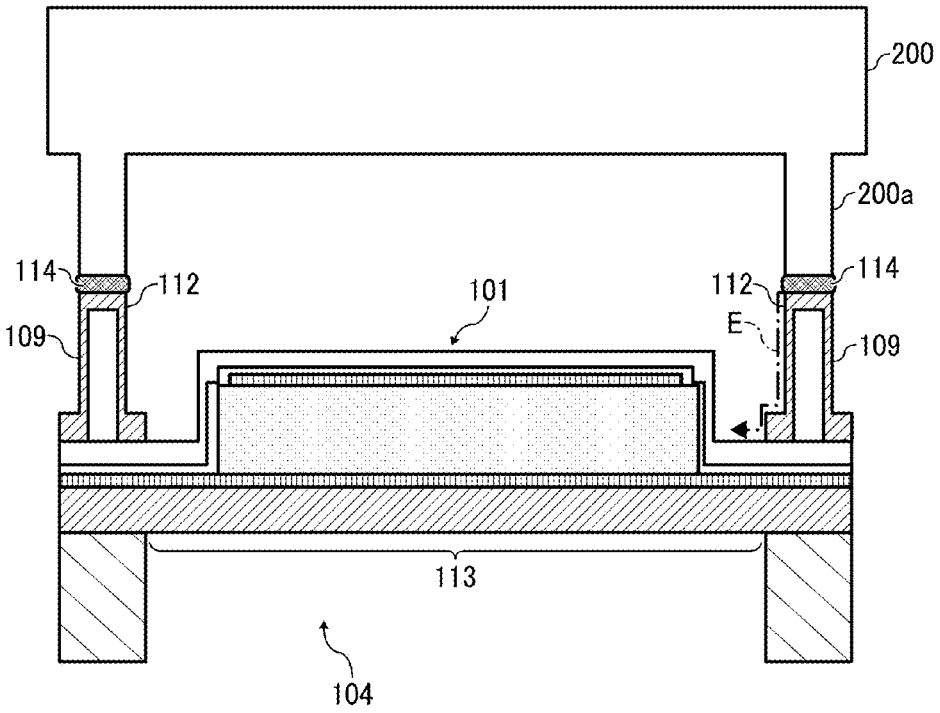
FIG. 10A is a cross-sectional view illustrating a piezoelectric element for discharging of the liquid droplet discharge head, along a direction in which nozzles are arranged.

FIG. 10A is a cross-sectional view illustrating the piezoelectric element 101 for discharging of the liquid droplet discharge head 50, along a direction in which nozzles are arranged.

Figure 10B:
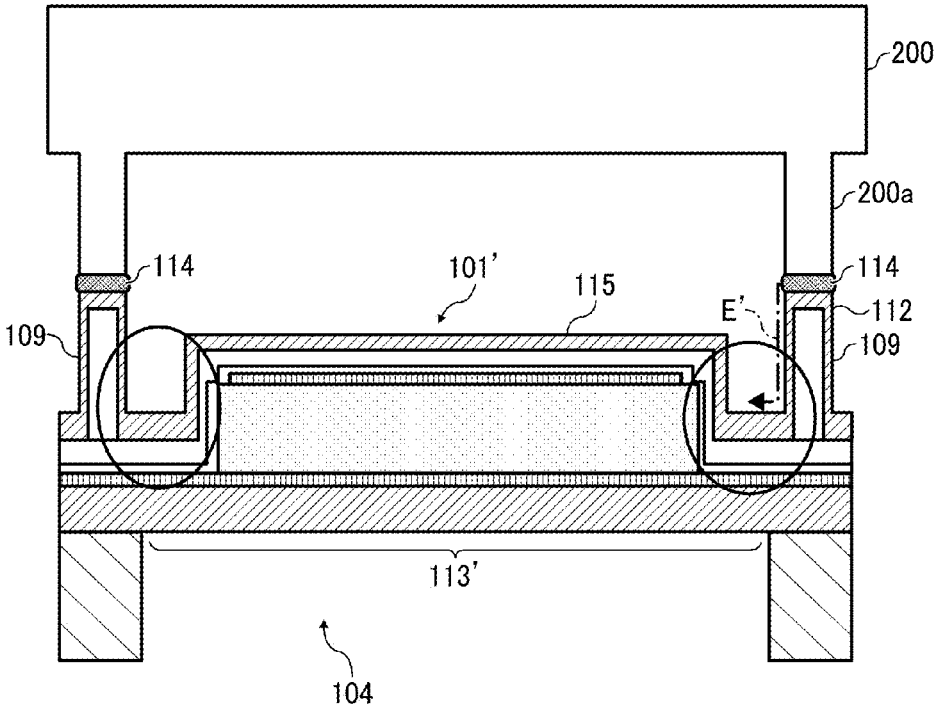
FIG. 10B is a cross-sectional view illustrating a piezoelectric element for inspection of the liquid droplet discharge head, along a direction in which nozzles are arranged.

FIG. 10B is a cross-sectional view illustrating the piezoelectric element 101' for inspection of the liquid droplet discharge head 50, along a direction in which nozzles are arranged. In the examples as illustrated in FIGS. 10A and 10B, the piezoelectric element 101 for discharging is covered by two protective layers.

In the present embodiment, the diaphragm displacement area 113' by the piezoelectric element 101' for inspection is covered by an additional layer 115 that is not formed for the diaphragm displacement area 113 of the piezoelectric element 101 for discharging. The additional layer 115 is formed first by uniformly forming the additional layer 115 to both of the diaphragm displacement area 113 defined by the piezoelectric element 101 for discharging and the diaphragm displacement area 113' defined by the piezoelectric element 101' for inspection, and second by removing part of the additional layer 115 corresponding to the diaphragm displacement area 113 defined by the piezoelectric element 101 for discharging by etching, and the like. The passivation film 112 formed by the process illustrated in FIG. 8A may be used as the additional layer 115.

By covering the diaphragm displacement area 113' by the piezoelectric element 101' for inspection with the additional layer 115, the shortest distance E' of the adhesive leaking path from the laminated position of the adhesive 114 as a leak source is made shorter than the shortest distance E of the adhesive leaking path as to the diaphragm displacement area 113 defined by the piezoelectric element 101 for discharging that is not covered by the additional layer 115.

More specifically, as illustrated in FIG. 10A, as to the piezoelectric element 101 for discharging, the adhesive 114 issuing from the laminated position as a leak source of the adhesive 114 flows downward along the wall surface of the attached member 109 on the diaphragm 102, reaches an upper surface of the diaphragm 102 and an upper surface of the protective layer if formed on the diaphragm 102, and reaches the diaphragm displacement area 113 defined by the piezoelectric element 101 for discharging. On the other hand, as to the piezoelectric element 101' for inspection, the adhesive 114 issuing from the laminated position reaches the diaphragm displacement area 113' defined by the piezoelectric element 101' for inspection along the similar adhesive leaking path. However, the length of the path upon reaching the diaphragm 102 from the laminated position is shorter by a depth of the additional layer 115. As a result, the adhesive leaking path E' of the piezoelectric element 101' for inspection up to the diaphragm displacement area 113' is shorter than the adhesive leaking path E of the piezoelectric element 101 for discharging up to the diaphragm displacement area 113.

Figure 11A:
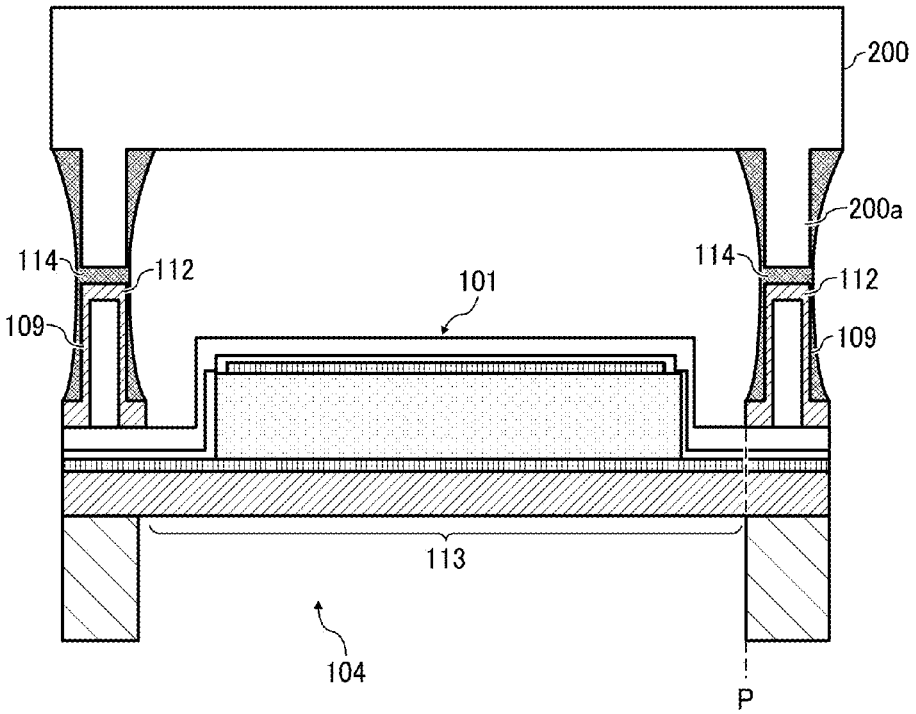
FIG. 11A is a cross-sectional view illustrating a state in which an adhesive leaks in the vicinity of the piezoelectric element for discharging.
Figure 11B:
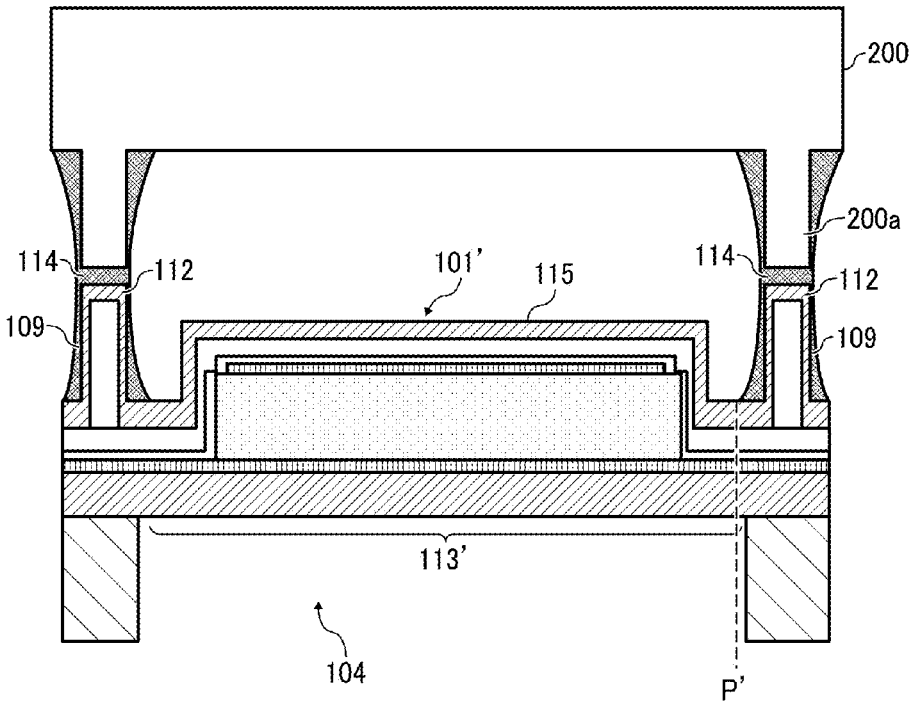
FIG. 11B is a cross-sectional view illustrating a state in which an adhesive leaks in the vicinity of the piezoelectric element for inspection.

With this structure, if the same amount of the adhesive 114 leaks from the laminated position, as illustrated in FIGS. 11A and 11B, the adhesive 114 reaches the diaphragm displacement area 113' defined by the piezoelectric element 101' for inspection earlier than the diaphragm displacement area 113 defined by the piezoelectric element 101 for discharging, and the amount of the adhesive 114 that has reached is greater. Specifically, the diaphragm displacement area 113' defined by the piezoelectric element 101' for inspection is adversely affected by the adhesive issuing from the laminated position more than the diaphragm displacement area 113 defined by the piezoelectric element 101 for discharging.

In particular, because a concave portion is formed on at least one of the laminated surface of the attached member 109 of the diaphragm 102 and the foot portion 200*a* of the retainer substrate 200, part of the excessive adhesive is filled in the concave portion, thereby preventing the adhesive from leaking from the laminated position. In this case, it is preferred that the volume of the concave portion formed on the laminated position as an issue source of the adhesive 114 flowing to the diaphragm displacement area 113' defined by the piezoelectric element 101' for inspection be smaller than that flowing to the diaphragm displacement area 113 defined by the piezoelectric element 101 for discharging. With this structure, the diaphragm displacement area 113' defined by the piezoelectric element 101' for inspection is adversely affected more than the diaphragm displacement area 113 defined by the piezoelectric element 101 for discharging.

As a result, if the result detected by detecting a displacement of the diaphragm displacement area 113' defined by the piezoelectric element 101' for inspection is optimal, it can be assumed with a high degree of certitude that the displacement of the diaphragm displacement area 113 defined by the piezoelectric element 101 for discharging is optimal. Accordingly, discharging properties of the liquid droplet discharge head 50 can be inspected with a high degree of certitude without detecting the displacement of the diaphragm displacement area 113 by each piezoelectric element 101 for discharging.

Next, a method for inspection of the discharging properties of the liquid droplet discharge head 50 according to the present embodiment is described below.

The discharging properties of the liquid droplet discharge head 50 according to the present embodiment can be inspected by applying a predetermined voltage to the piezoelectric element 101' for inspection and by detecting a displacement of the diaphragm displacement area 113' due to the above application. More specifically, before attaching the liquid droplet discharge head 50 to the liquid droplet discharge head 50, the diaphragm displacement area 113' is inspected by a differential interference microscope from the side of the pressurized liquid chamber 104. The differential interference microscope can provide an image with a high contrast relative to a minute concavity and convexity.

Figure 12:
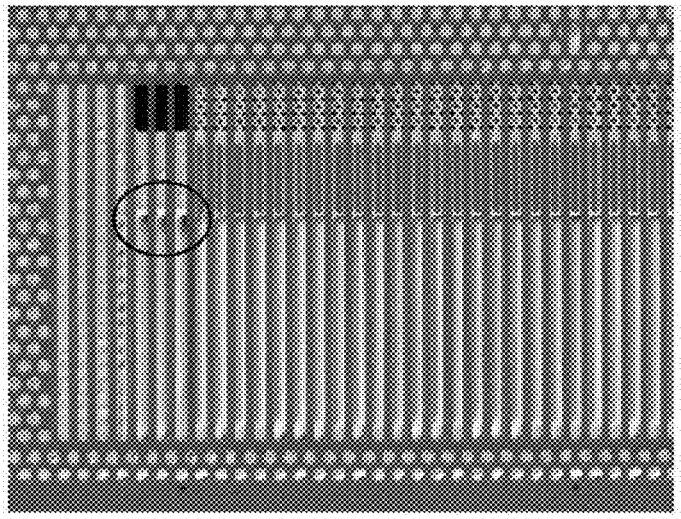
FIG. 12 is a photo of the piezoelectric element for inspection around a diaphragm displacement area taken by a differential microscope seen from a pressurized liquid chamber.

FIG. 12 is a photo of the diaphragm displacement area 113' taken by the differential interference microscope from the side of the pressurized liquid chamber 104. In the example as illustrated in FIG. 12, three piezoelectric elements 101' for inspection are disposed at an end in the alignment direction of the piezoelectric elements 101 for discharging.

When the adhesive 114 reaches the diaphragm displacement area 113' of the piezoelectric element 101' for inspection, the rigidity of the diaphragm 102 changes and the displacement or bending of the diaphragm 102 differs from the original. More specifically, when the adhesive 114 reaches the diaphragm displacement area 113' of the piezoelectric element 101' for inspection, the displacement or bending of the diaphragm 102 is shown by shading or contrast as indicated by a circle of FIG. 12. In contrast, when the adhesive 114 does not reach the diaphragm displacement area 113' defined by the piezoelectric element 101' for inspection, the diaphragm displacement area 113' defined by the piezoelectric element 101' for inspection is represented by the shading or contrast similar to the diaphragm displacement area 113 defined by the piezoelectric element 101 for discharging.

Whether the discharging properties of the liquid droplet discharge head 50 are optimal or not is determined by inspecting the diaphragm displacement area 113' defined by the piezoelectric element 101' for inspection.

In the present embodiment, the displacement or bending of the diaphragm displacement area 113' defined by the piezoelectric element 101' for inspection is determined by the observation employing the differential interference microscope, but the method thereof is not limited thereto. The present detection method is useful as an inspection method for mass production because the inspection can be performed as a non-destructive method.

<Modification 1>

Next, a modification of the liquid droplet discharge head 50 according to the present embodiment is described below.

Figure 13:
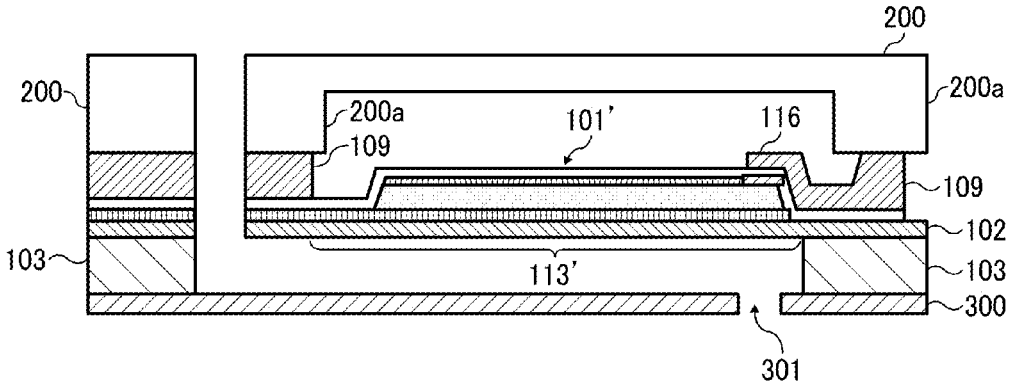
FIG. 13 is a cross-sectional view illustrating a modification 1 of the piezoelectric element for inspection of the liquid droplet discharge head, along the direction perpendicular to the direction in which nozzles are arranged.

FIG. 13 is a cross-sectional view illustrating the modification 1 of the piezoelectric element 101' for inspection of the liquid droplet discharge head 50, along the direction perpendicular to the direction in which nozzles are arranged.

In the present modification 1, a stepped portion 116 is disposed along the adhesive leaking path toward the diaphragm displacement area 113' including the path after reaching the diaphragm displacement area 113'.

Figure 14A:
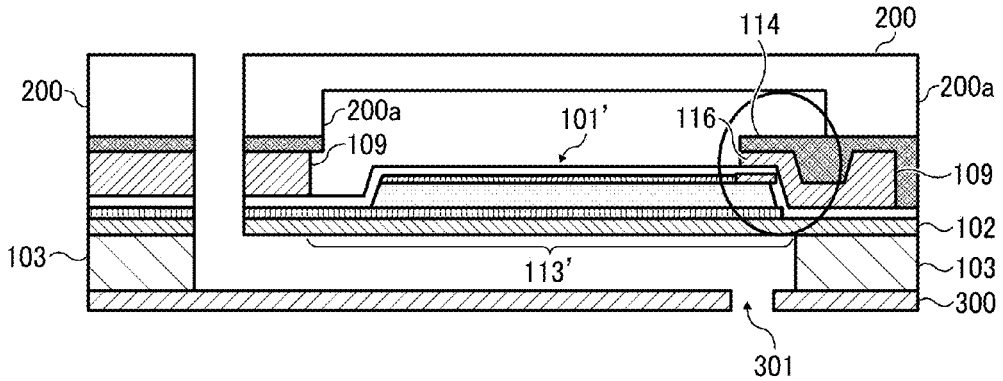
FIGS. 14A and 14B are explanatory views for comparing before and after the adhesive goes beyond a step portion of the liquid droplet discharge head.
Figure 14B:
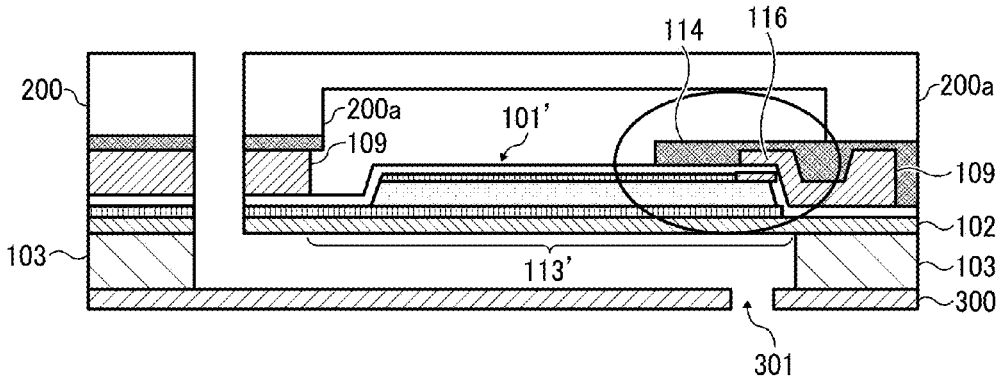

With such a stepped portion 116, effects of the adhesive 114 given to the displacement or bending of the diaphragm 102 differ discontinuously before and after the leaking adhesive 114 exceeds the stepped portion 116. Specifically, as illustrated in FIG. 14A, until the leaking adhesive 114 exceeds the stepped portion 116, effects of the adhesive 114 given to the diaphragm displacement area 113' in the downstream of the adhesive leaking path are small and no large change in the displacement or bending is observed. However, as illustrated in FIG. 14B, when the leaking of the adhesive 114 exceeds the stepped portion 116, effects of the adhesive 114 given to the diaphragm displacement area 113' in the downstream of the adhesive leaking path are great and a great change appears. As a result, from the detection result of the change in the displacement or bending of the diaphragm 102, a degree of the effect of the adhesive given to the discharging properties should be divided into definitive ranks.

Figure 15:
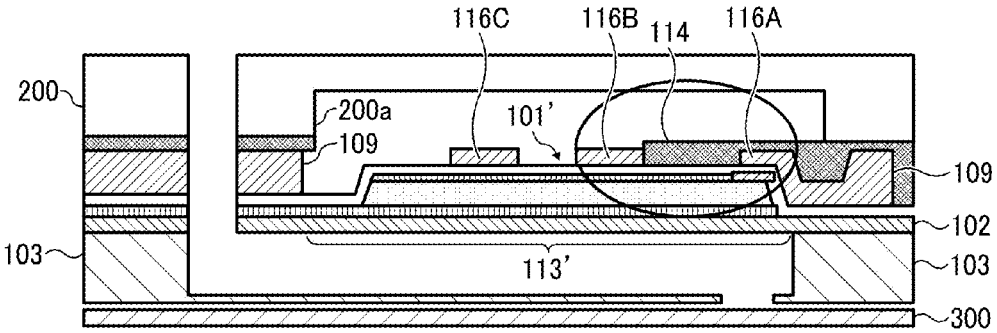
FIG. 15 is a cross-sectional view illustrating a piezoelectric element for inspection of the liquid droplet discharge head as another example of the modification 1, along the direction perpendicular to the direction in which nozzles are arranged.

In particular, as illustrated in FIG. 15, provision of a plurality of stepped portions 116A, 116B, 116C enables to divide into several steps.

<Modification 2>

Next, a second modification 2 of the liquid droplet discharge head 50 according to the present embodiment is described below.

Figure 16:
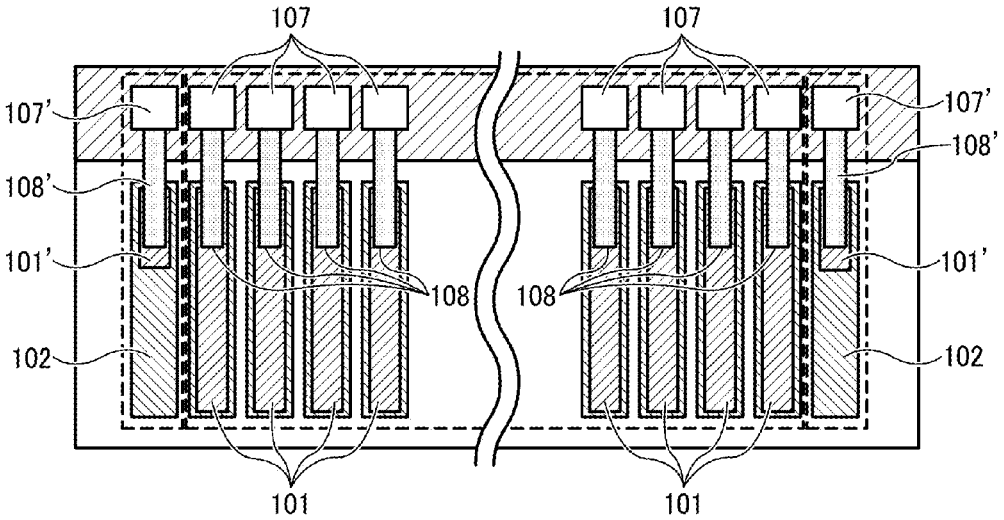
FIG. 16 illustrates an upper surface of an actuator substrate that constructs the liquid droplet discharge head as a modification 2.
Figure 17:
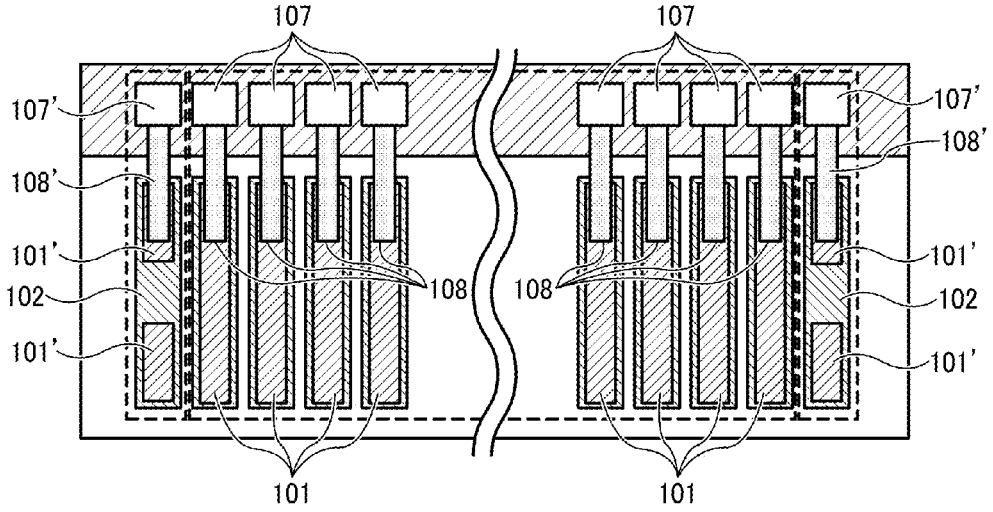
FIG. 17 illustrates an upper surface of another actuator substrate that constructs the liquid droplet discharge head as another example of the modification 2.

FIG. 16 illustrates an upper surface of an actuator substrate that constructs the liquid droplet discharge head 50 as the modification 2. FIG. 17 illustrates an upper surface of another exemplary actuator substrate that constructs the liquid droplet discharge head 50 as the modification 2.

In the present modification 2, an area of the piezoelectric element 101' for inspection in the diaphragm displacement area 113' shared by the piezoelectric element 101' for inspection is smaller than the area of the piezoelectric element 101 for discharging in the diaphragm displacement area 113 shared by the piezoelectric element 101 for discharging. With this configuration, the amount of the leaked adhesive that directly contacts the upper surface of the diaphragm displacement area 113' by the piezoelectric element 101' for inspection is greater than that of the leaked adhesive that directly contacts the upper surface of the diaphragm displacement area 113 by the piezoelectric element 101 for discharging. (The upper surface above may be a further upper surface of the protective layer and the additional layer, if any.) When the adhesive directly contacts the upper surface of the diaphragm 102, effects of the adhesive on the displacement or bending of the diaphragm 102 are magnified, so that the displacement or bending of the diaphragm 102 due to the adhesive can be detected more easily in the diaphragm displacement area 113' by the piezoelectric element 101' for inspection. As a result, discharging status can be inspected more correctly.

<Modification 3>

Next, another and further modification 3 of the liquid droplet discharge head 50 according to the present embodiment is described below.

Figure 18:
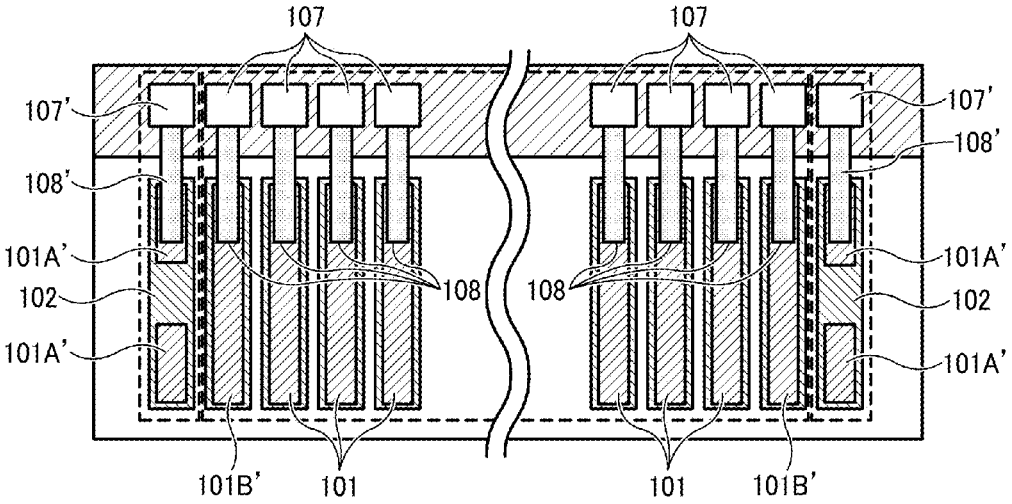
FIG. 18 illustrates an upper surface of an actuator substrate that constructs the liquid droplet discharge head as a modification 3.

FIG. 18 illustrates an upper surface of an actuator substrate that constructs the liquid droplet discharge head 50 as the modification 3.

In the modification 3, two pieces each of the piezoelectric elements 101A', 101B' for inspection are disposed at lateral ends of the array of piezoelectric elements 101. The extent of the impact of the adhesive 114 leaking from the laminated position on the displacement of the diaphragm displacement area 113' by the piezoelectric element 101' for inspection varies between the two piezoelectric elements 101A', 101B' for inspection disposed at each end. Specifically, an area of the piezoelectric element 101' for inspection of the diaphragm displacement area 113' by the piezoelectric elements 101A', 101B' for inspection is different. With this structure, when the amount of the leaked adhesive is relatively small, the diaphragm displacement area 113' by the piezoelectric element 101A' for inspection that is susceptible to the effect of the leaked adhesive, that is, the area is smaller, receives more effects from the displacement or bending of the diaphragm. By contrast, the diaphragm displacement area 113' by the piezoelectric element 101B' for inspection (that is not susceptible to the effect of the leaked adhesive, that is, the area is larger) does not receive much effects from the displacement or bending of the diaphragm. On the other hand, when the amount of the leaked adhesive is relatively large, even the diaphragm displacement area 113' by the piezoelectric element 101B' for inspection (that is not susceptible to the effect of the leaked adhesive, that is, the area is larger) is not affected by the displacement or bending of the diaphragm. As a result, a degree of effects of the adhesive on the discharging operation can be clearly classified.

According to the present embodiment, ink is to be discharged, but the ink is not limited to so-called ink, but is used as an inclusive term for every liquid used for discharging droplets, and includes, for example, DNA samples, resist, and pattern materials.

Further, the present embodiments refer to a case in which the actuator substrate is used for the liquid droplet discharge head 50 in the inkjet recording apparatus; however, the actuator substrate according to the present embodiment may be applied to other parts and components. For example, the present actuator substrate can be applied to a drive unit of a polarization mirror, of which direction is deflected by a displacement of a displacement plate of the actuator substrate.

The aforementioned embodiments are examples and specific effects can be obtained for each of the following aspects of (A) to (G):

<Aspect A>

A liquid droplet discharge member such as a liquid droplet discharge head 50 includes a nozzle substrate 300; nozzles 301 to discharge a liquid such as ink disposed on the nozzle substrate 300; a pressurized liquid chamber 104 that communicates with the nozzle; a displacement plate such as a diaphragm 102 that forms part of the wall of the pressurized liquid chamber 104; an electromechanical transducer element for discharging such as a piezoelectric element 101 for discharging disposed on a surface of the substrate opposite the side facing the pressurized liquid chambers 104 in the diaphragm 102; and a retainer substrate 200 as an attachment target laminated to the substrate mounting surface of the diaphragm 102 directly or indirectly via an intermediate member such as the attached member 109 with an adhesive 114. The liquid droplet discharge head 50 is configured to perform discharging the liquid inside the pressurized liquid chambers 104 from the nozzles 301, because the diaphragm 102 is displaced by a drive voltage applied to the electromechanical transducer element for discharging. The liquid droplet discharge head 50 further includes the electromechanical transducer element such as the piezoelectric elements 101', 101A', 101B' for inspection that do not perform discharging, are disposed on the element mount surface of the diaphragm, and are applied with voltage so that the diaphragm 102 displaces, in which a shortest distance E' of the adhesive leaking path from the laminated position of the adhesive 114 to the diaphragm displacement area 113 by the piezoelectric element 101' for inspection is smaller than the shortest distance E of the adhesive leaking path to the diaphragm displacement area 113 by the piezoelectric element 101 for discharging.

In the conventional liquid discharge member having a structure to laminate parts with an adhesive, the excessive adhesive leaking from the laminated position may adversely affect the liquid discharging performance. For example, in the liquid droplet discharge member to discharge a liquid inside the pressurized liquid chamber from nozzles by applying a drive voltage to an electromechanical transducer element on the diaphragm so as to displace the diaphragm, there is a case in which a to-be-laminated member is directly or indirectly attached, with an adhesive, to the mount surface of the element on which the electromechanical transducer element of the diaphragm is mounted. In this case, the excessive adhesive leaking from the laminated position may flow due to its own weight to reach the diaphragm displacement area defined by the electromechanical transducer element, so that the rigidity of the diaphragm is adversely affected. As a result, the diaphragm will not displace sufficiently even though a drive voltage is applied to the electromechanical transducer element, so that a discharge failure may occur. Accordingly, it is important to inspect whether or not the diaphragm displacement area properly displaces by the electromechanical transducer element after lamination.

However, when the diaphragm displacement area by the electromechanical transducer element corresponding to each nozzle has to be inspected, because the liquid discharge member used for the inkjet recording apparatus includes many nozzles, inspection steps are complicated. Therefore, a simplified inspection method has been desired.

In Aspect A, a structure specialized for the inspection is adapted to the piezoelectric element 101' for inspection, without considering discharging operation. According to Aspect A, the shortest distance of the adhesive leaking path between the laminated position and the diaphragm displacement area by the electromechanical transducer element for inspection is shorter than the shortest distance of the adhesive leaking path between the laminated position and the diaphragm displacement area by the electromechanical transducer element for discharging. As a result, the same amount of adhesive leaks, the leaked adhesive reaches the diaphragm displacement area by the electromechanical transducer element for inspection earlier than the diaphragm displacement area by the electromechanical transducer element for discharging and the reached amount of the adhesive is greater in the diaphragm displacement area by the electromechanical transducer element for inspection. Specifically, the diaphragm displacement area by the electromechanical transducer element for inspection is adversely affected more than the diaphragm displacement area by the electromechanical transducer element for discharging. As a result, if the result detected by detecting a displacement of the diaphragm displacement area 113' defined by the piezoelectric element 101' for inspection is optimal, it can be assumed with a high degree of certitude that the displacement of the diaphragm displacement area 113 defined by the piezoelectric element 101 for discharging is optimal. Accordingly, discharging properties of the liquid droplet discharge head 50 can be inspected with a high degree of certitude without detecting the displacement of the diaphragm displacement area 113 by each piezoelectric element 101 for discharging. Therefore, compared to a case of inspecting discharging operation of the liquid discharge head by detecting a displacement of the diaphragm displacement area by each electromechanical transducer element for discharging, the discharging performance of the liquid discharge head can be inspected simply and easily.

<Aspect B>

In Aspect A, at least one stepped portion is disposed on an element mount surface of the diaphragm along the adhesive leaking path from the laminated position toward the diaphragm displacement area by the electromechanical transducer element for inspection.

With such a stepped portion, effects of the adhesive on the displacement of the diaphragm differ discontinuously before and after the leaking adhesive exceeds the stepped portion. As a result, from the detection result of the change in the displacement of the diaphragm, a degree of the effect of the adhesive given to the discharging properties can be divided into definitive ranks.

<Aspect C>

In Aspect A or B, an area of the piezoelectric element for inspection in the diaphragm displacement area shared by the piezoelectric element for inspection is smaller than the area of the piezoelectric element for discharging in the diaphragm displacement area shared by the piezoelectric element for discharging.

Effects of the leaked adhesive on the displacement of the diaphragm is greater in a case in which the adhesive directly contacts an upper surface of the diaphragm than in a case in which the adhesive covers the diaphragm on top of the electromechanical transducer element. With this configuration, the displacement of the diaphragm due to the adhesive in the diaphragm displacement area by the electromechanical transducer element for inspection can be detected easily, and the performance of the discharging operation can be more properly inspected.

<Aspect D>

In either one of Aspect A to C, a volume of a concave portion formed on the laminated position at a shortest distance relative to the diaphragm displacement area defined by the electromechanical transducer element for inspection is smaller than that of a concave portion formed on the laminated position at a shortest distance relative to the diaphragm displacement area defined by the electromechanical transducer element for discharging.

With this structure, the diaphragm displacement area defined by the electromechanical transducer element for inspection is adversely affected by the adhesive leaked from the laminated position more than the diaphragm displacement area defined by the electromechanical transducer element for discharging.

<Aspect E>

In either one of Aspect A to D, two or more electromechanical transducer elements for inspection are disposed on the element mount surface of the diaphragm and a degree of effects of the adhesive leaking from the laminated position given to the displacement of the diaphragm displacement area by the electromechanical transducer elements for inspection varies between the two or more electromechanical transducer elements for inspection.

With this structure, as described in the modification 3, when the amount of the leaked adhesive is relatively small, the diaphragm displacement area by the electromechanical transducer element for inspection that is susceptible to the effect of the leaked adhesive, receives more effects from the displacement of the diaphragm. On the other hand, when the amount of the leaked adhesive is relatively large, even the diaphragm displacement area by the electromechanical transducer element for inspection that is not susceptible to the effect of the leaked adhesive, is not affected by the displacement of the diaphragm. As a result, a degree of effects of the adhesive on the discharging operation can be clearly classified.

<Aspect F>

An image forming apparatus such as an inkjet recording apparatus to discharge a liquid such as ink from a liquid discharge member such as a liquid droplet discharge head 50, thereby forming an image, employs the liquid droplet discharge member according to either one of Aspect A to E.

With this, an image forming apparatus with less discharge failure can be provided.

<Aspect G>

In the liquid droplet discharge member in either one of Aspects A to E, the displacement of the diaphragm displacement area by the electromechanical transducer element for inspection is detected from the pressurized liquid chamber, and the discharging operation of the liquid droplet discharge head is inspected based on the detection result.

According to this, compared to a case of inspecting discharging operation of the liquid discharge head by detecting a displacement of the diaphragm displacement area by each electromechanical transducer element for discharging, the discharging performance of the liquid discharge head can be inspected simply and easily.

Additional modifications and variations of the present invention are possible in light of the above teachings. It is therefore to be understood that, within the scope of the appended claims, the invention may be practiced other than as specifically described herein.

What is claimed is:

1. A liquid droplet discharge head comprising:

a nozzle substrate;

nozzles, disposed on the nozzle substrate, to discharge a liquid;

a pressurized liquid chamber that communicates with the nozzles;

a diaphragm forming one wall of the pressurized liquid chamber;

an electromechanical transducer element for discharging, disposed on an element mount surface of the diaphragm opposite a side facing the pressurized liquid chamber; and a retainer substrate laminated to the element mount surface of the diaphragm with an adhesive, wherein the liquid droplet discharge head is configured to discharge a liquid inside the pressurized liquid chamber from the nozzles while the diaphragm is displaced by a drive voltage applied to the electromechanical transducer element for discharging, the liquid droplet discharge head further comprising an electromechanical transducer element for inspection that does not perform discharging, disposed on the element mount surface of the diaphragm, to which a voltage is applied so that the diaphragm displaces, wherein a shortest distance of an adhesive leaking path from a laminated position of the adhesive to a diaphragm displacement area by the electromechanical transducer element for inspection is smaller than a shortest distance of an adhesive leaking path from the laminated position of the adhesive to a diaphragm displacement area by the electromechanical transducer element for discharging.

2. The liquid droplet discharge head as claimed in claim 1, further comprising at least one stepped portion disposed on the element mount surface of the diaphragm along the adhesive leaking path from the laminated position toward the diaphragm displacement area by the electromechanical transducer element for inspection.

3. The liquid droplet discharge head as claimed in claim 1, wherein an area of the electromechanical transducer element for inspection in the diaphragm displacement area shared by the electromechanical transducer element for inspection is smaller than the area of the electromechanical transducer element for discharging in the diaphragm displacement area shared by the electromechanical transducer element for discharging.

4. The liquid droplet discharge head as claimed in claim 1, further comprising a concave portion formed on the laminated position at the shortest distance relative to the diaphragm displacement area by the electromechanical transducer element for inspection, the concave portion having a volume smaller than that of a concave portion formed on the laminated position at the shortest distance relative to the diaphragm displacement area by the electromechanical transducer element for discharging.

5. The liquid droplet discharge head as claimed in claim 1, further comprising two or more electromechanical transducer elements for inspection disposed on the element mount surface of the diaphragm, wherein effects of the adhesive leaking from the laminated position on displacement of diaphragm displacement areas by the electromechanical transducer elements for inspection vary between the two or more electromechanical transducer elements for inspection.

6. An image forming apparatus, comprising:

the liquid droplet discharge head as claimed in claim 1 to discharge the liquid to form an image.

* * * * *